US007169539B2

(12) United States Patent
Lim et al.

(10) Patent No.: US 7,169,539 B2
(45) **Date of Patent: *Jan. 30, 2007**

(54) MONOLITHIC INK-JET PRINTHEAD HAVING A TAPERED NOZZLE AND METHOD FOR MANUFACTURING THE SAME

(75) Inventors: Hyung-taek Lim, Seoul (KR); Jong-woo Shin, Suwon (KR); Hoon Song, Seoul (KR); Yong-soo Oh, Seongnam (KR); Chang-seung Lee, Seongnam (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/084,097

(22) Filed: Mar. 21, 2005

(65) Prior Publication Data

US 2005/0162482 A1 Jul. 28, 2005

Related U.S. Application Data

(62) Division of application No. 10/688,952, filed on Oct. 21, 2003, now Pat. No. 6,886,919.

(30) Foreign Application Priority Data

Oct. 21, 2002 (KR) ..... 2002-64344

(51) Int. Cl.
*B41J 2/16* (2006.01)

(52) U.S. Cl. ..... 430/320; 216/27

(58) Field of Classification Search ..... None
See application file for complete search history.

(56) References Cited

U.S. PATENT DOCUMENTS

| | | | |
|---|---|---|---|
| 4,882,595 | A | 11/1989 | Trueba et al. |
| 5,841,452 | A | 11/1998 | Silverbrook |
| 5,855,835 | A | 1/1999 | Gordon et al. |
| 5,859,654 | A | 1/1999 | Radke et al. |
| 6,412,918 | B1 | 7/2002 | Chen et al. |

(Continued)

FOREIGN PATENT DOCUMENTS

| | | | |
|---|---|---|---|
| EP | 1 174 268 | A1 | 1/2002 |

(Continued)

*Primary Examiner*—John A. McPherson
(74) *Attorney, Agent, or Firm*—Lee & Morse, P.C.

(57) ABSTRACT

A monolithic ink-jet printhead includes a substrate having an ink chamber, a manifold, and an ink channel in flow communication, a nozzle plate including a plurality of passivation layers stacked on the substrate and a heat dissipating layer stacked on the passivation layers, a nozzle for ejecting ink penetrating the nozzle plate, a heater provided between adjacent passivation layers above the ink chamber, and a conductor between adjacent passivation layers, the conductor being electrically connected to the heater, wherein the heat dissipating layer is made of a thermally conductive metal for dissipating heat from the heater, the lower part of the nozzle is formed by penetrating the plurality of passivation layers, and the upper part of the nozzle is formed by penetrating the heat dissipating layer in a tapered shape in which a cross-sectional area thereof decreases gradually toward an exit thereof.

19 Claims, 13 Drawing Sheets

U.S. PATENT DOCUMENTS

| | | | | |
|---|---|---|---|---|
| 6,984,024 | B2 * | 1/2006 | Shin et al. | 347/56 |
| 2002/0008733 | A1 | 1/2002 | Lee et al. | |
| 2002/0008738 | A1 | 1/2002 | Lee et al. | |
| 2002/0039123 | A1 | 4/2002 | Lee et al. | |
| 2002/0041301 | A1 | 4/2002 | Jeon et al. | |
| 2004/0075707 | A1 * | 4/2004 | Shin et al. | 347/18 |

FOREIGN PATENT DOCUMENTS

| | | |
|---|---|---|
| EP | 1 215 048 A2 | 6/2002 |
| EP | 1 215 048 A3 | 6/2002 |
| EP | 1 221 374 A2 | 7/2002 |
| EP | 1 221 374 A3 | 7/2002 |

* cited by examiner

MONOLITHIC INK-JET PRINTHEAD HAVING A TAPERED NOZZLE AND METHOD FOR MANUFACTURING THE SAME

CROSS REFERENCE TO RELATED APPLICATION(S)

This is a divisional application based on application Ser. No. 10/688,952, filed Oct. 21, 2003 now U.S. Pat. No. 6,886,919.

BACKGROUND OF THE INVENTION

1. Field of the Invention

The present invention relates to an ink-jet printhead. More particularly, the present invention relates to a thermally driven monolithic ink-jet printhead in which a nozzle plate, including a tapered nozzle, is formed integrally with a substrate and a method for manufacturing the same.

2. Description of the Related Art

In general, ink-jet printheads are devices for printing a predetermined image, color or black, by ejecting a small volume droplet of a printing ink at a desired position on a recording sheet. Ink-jet printheads are largely classified into two types depending on the ink droplet ejection mechanisms: a thermally driven ink-jet printhead, in which a heat source is employed to form and expand a bubble in ink thereby causing an ink droplet to be ejected, and a piezoelectrically driven ink-jet printhead, in which a piezoelectric crystal bends to exert pressure on ink causing an ink droplet to be expelled.

An ink droplet ejection mechanism of a thermally driven ink-jet printhead will now be described in detail. When a pulse current flows through a heater formed of a resistive heating material, heat is generated by the heater. The heat causes ink near the heater to be rapidly heated to approximately 300° C., thereby boiling the ink and generating a bubble in the ink. The formed bubble expands and exerts pressure on ink contained within an ink chamber. This pressure causes a droplet of ink to be ejected through a nozzle from the ink chamber.

A thermally driven ink-jet printhead can be further subdivided into top-shooting, side-shooting, and back-shooting type depending on the direction in which the ink droplet is ejected and the direction in which a bubbles expands. While the top-shooting type refers to a mechanism in which an ink droplet is ejected in a direction the same as a direction in which a bubble expands, the back-shooting type is a mechanism in which an ink droplet is ejected in a direction opposite to a direction in which a bubble expands. In the side-shooting type, the direction of ink droplet ejection is perpendicular to the direction of bubble expansion.

Thermally driven ink-jet printheads need to meet the following conditions. First, a simple manufacturing process, low manufacturing cost, and mass production must be provided. Second, to produce high quality color images, the distance between adjacent nozzles must be as small as possible while still preventing cross-talk between the adjacent nozzles. More specifically, to increase the number of dots per inch (DPI), many nozzles must be arranged within a small area. Third, for high-speed printing, a cycle beginning with ink ejection and ending with ink refill must be as short as possible. That is, the heated ink and heater should cool down quickly to increase an operating frequency.

FIG. 1A illustrates a partial cross-sectional perspective view showing a structure of a conventional thermally driven printhead. FIG. 1B illustrates a cross-sectional view of the printhead of FIG. 1A for explaining a process of ejecting an ink droplet.

Referring to FIGS. 1A and 1B, a conventional thermally driven ink-jet printhead includes a substrate 10, a barrier wall 14 disposed on the substrate 10 for defining an ink chamber 26 filled with ink 29, a heater 12 installed in the ink chamber 26, and a nozzle plate 18 having a tapered nozzle 16 for ejecting an ink droplet 29'. If a pulse current is supplied to the heater 12, the heater 12 generates heat to form a bubble 28 due to the heating of the ink 29 contained within the ink chamber 26. The formed bubble 28 expands to exert pressure on the ink 29 contained within the ink chamber 26, which causes an ink droplet 29' to be ejected through the tapered nozzle 16. Then, the ink 29 is introduced from a manifold 22 through an ink channel 24 to refill the ink chamber 26.

The process of manufacturing a conventional top-shooting type ink-jet printhead configured as above involves separately manufacturing the nozzle plate 18 equipped with the tapered nozzle 16 and the substrate 10 having the ink chamber 26 and the ink channel 24 formed thereon and bonding them to each other. These required steps complicate the manufacturing process and may cause a misalignment during the bonding of the nozzle plate 18 with the substrate 10.

Recently, in an effort to overcome the above problems of the conventional ink-jet printheads, ink-jet printheads having a variety of structures have been proposed. FIGS. 2A and 2B illustrate a conventional monolithic ink-jet printhead. FIGS. 2A and 2B illustrate a plan view showing an example of a conventional monolithic ink-jet printhead and a vertical cross-sectional view taken along line A–A' of FIG. 2A, respectively.

Referring to FIGS. 2A and 2B, a hemispherical ink chamber 32 and a manifold 36 are formed on a front surface and a rear surface of a silicon substrate 30, respectively. An ink channel 34 is formed at a bottom of the ink chamber 32 and connects the ink chamber 32 with the manifold 36. A nozzle plate 40, including a plurality of material layers 41, 42, and 43 stacked on the substrate 30, is formed integrally with the substrate 30. The nozzle plate 40 has a nozzle 47 formed at a location corresponding to a central portion of the ink chamber 32. A heater 45 connected to a conductor 46 is disposed around the nozzle 47. A nozzle guide 44 extends along an edge of the nozzle 47 toward a depth direction of the ink chamber 32. Heat generated by the heater 45 is transferred through an insulating layer 41 to ink 48 within the ink chamber 32. The ink 48 then boils to form bubbles 49. The formed bubbles 49 expand to exert pressure on the ink 48 contained within the ink chamber 32, which causes an ink droplet 48' to be ejected through the nozzle 47. Then, the ink 48 flows through the ink channel 34 from the manifold 36 due to surface tension of the ink 48 contacting the air to refill the ink chamber 32.

A conventional monolithic ink-jet printhead configured as above has an advantage in that the silicon substrate 30 is formed integrally with the nozzle plate 40 thereby simplifying the manufacturing process and eliminating the chance of misalignment.

In the monolithic ink-jet printhead shown in FIGS. 2A and 2B, however, it is difficult to make the material layers 41, 42, and 43 of the nozzle plate 40 thick since they are formed by a chemical vapor deposition (CVD) process. That is, since the nozzle plate 40 has a thickness as small as about 5 μm, it is difficult to provide a sufficient length of the nozzle 47. A small length of the nozzle 47 not only decreases the directionality of the ink droplet 48' ejected but also prohibits stable high speed printing since a meniscus in the surface of the ink 48, which cannot be formed within the nozzle 47 after ejection of the ink droplet 48', moves within the ink chamber 32. Further, since the nozzle 47 is formed by etching the material layers 41, 42, and 43, it is difficult to form a nozzle 47 having a tapered shape, i.e., having a shape in which a diameter of the nozzle 47 decreases gradually toward an exit thereof.

In an effort to solve these problems, the conventional ink-jet printhead has the nozzle guide 44 formed along the edge of the nozzle 47. However, if the nozzle guide 44 is too long, this not only makes it difficult to form the ink chamber 32 by etching the substrate 30 but also restricts expansion of the bubbles 49. Thus, use of the nozzle guide 44 causes a restriction on sufficiently providing the length of the nozzle 47.

In addition, in the conventional inkjet printhead, the material layers 41, 42, and 43 disposed around the heater 45 are made from low heat conductive insulating materials, such as an oxide or a nitride, to provide electrical insulation. Thus, a significant time must elapse for the heater 45, the ink 48 within the ink chamber 32, and the nozzle guide 44, all of which are heated for ejection of the ink 48, to sufficiently cool down and return to an initial state, thereby making it difficult to increase an operating frequency of the printhead to a sufficient level.

SUMMARY OF THE INVENTION

It is a feature of an embodiment of the present invention to provide a monolithic ink-jet printhead that is capable of increasing the directionality of an ink droplet, an ejection speed, and heat sinking capability using a tapered nozzle on a thick metal.

It is another feature of an embodiment of the present invention to provide a method for manufacturing the monolithic ink-jet printhead.

According to a feature of the present invention, there is provided a monolithic ink-jet printhead, including a substrate having an ink chamber to be supplied with ink to be ejected, a manifold for supplying ink to the ink chamber, and an ink channel in communication with the ink chamber and the manifold, a nozzle plate including a plurality of passivation layers stacked on the substrate and a heat dissipating layer stacked on the plurality of passivation layers, a nozzle, including a lower part and an upper part, the nozzle penetrating the nozzle plate so that ink ejected from the ink chamber is ejected through the nozzle, a heater provided between adjacent passivation layers of the plurality of passivation layers of the nozzle plate, the heater being located above the ink chamber for heating ink within the ink chamber, and a conductor between adjacent passivation layers of the plurality of passivation layers of the nozzle plate, the conductor being electrically connected to the heater for applying current to the heater, wherein the heat dissipating layer is made of a thermally conductive metal for dissipating heat from the heater, the lower part of the nozzle is formed by penetrating the plurality of passivation layers, and the upper part of the nozzle is formed by penetrating the heat dissipating layer in a tapered shape in which a cross-sectional area thereof decreases gradually toward an exit thereof.

Preferably, the plurality of passivation layers include first, second, and third passivation layers sequentially stacked on the substrate, the heater is formed between the first and second passivation layers, and the conductor is formed between the second and third passivation layers.

Preferably, the lower part of the nozzle may have a cylindrical shape.

It is preferable that the heat dissipating layer is formed by electroplating to a thickness of about 10–50 μm, and the upper part of the nozzle has a length of about 10–50 μm.

It is preferable that the nozzle plate has a heat conductive layer located above the ink chamber, the heat conductive layer being insulated from the heater and the conductor and thermally contacts the substrate and the heat dissipating layer.

It is preferable that the conductor and the heat conductive layer are made of the same metal and located on the same passivation layer.

An insulating layer may be interposed between the conductor and the heat conductive layer.

Further, a nozzle guide extending into the ink chamber may be formed in the lower part of the nozzle.

In a printhead according to an embodiment of the present invention, the upper part of the nozzle having the tapered shape is formed on the heat dissipating layer made of a thick metal so that the directionality of an ink droplet, an ejection speed, and heat sinking capability are increased, thereby improving the ink ejection performance and an operating frequency.

According to an aspect of the present invention, there is provided a method for manufacturing a monolithic ink-jet printhead, includes (a) preparing a substrate, (b) stacking a plurality of passivation layers on the substrate and forming a heater and a conductor connected to the heater between adjacent passivation layers of the plurality of passivation layers, (c) forming a heat dissipating layer made of a metal on the plurality of passivation layers, forming a lower nozzle on the passivation layers, and forming an upper nozzle on the heat dissipating layer in a tapered shape in which a cross-sectional area thereof decreases gradually toward an exit to construct a nozzle plate including the passivation layers and the heat dissipating layer integrally with the substrate, and (d) etching the substrate to form an ink chamber to be supplied with ink, a manifold for supplying ink to the ink chamber, and an ink channel for connecting the ink chamber with the manifold.

Preferably, the substrate is made of a silicon wafer.

Preferably, (b) comprises forming a first passivation layer on an upper surface of the substrate; forming the heater on the first passivation layer; forming a second passivation layer on the first passivation layer and the heater; forming the conductor on the second passivation layer; and forming a third passivation layer on the second passivation layer and the conductor.

It is preferable that in (b), a heater conductive layer located above the ink chamber is formed between the passivation layers, whereby the heat conductive layer is insulated from the heater and conductor and contacts the substrate and heat dissipating layer.

The heat conductive layer and the conductor may be simultaneously formed from the same metal.

After forming an insulating layer on the conductor, the heater conductive layer may be formed on the insulating layer.

It is preferable that (c) includes etching the passivation layers on the inside of the heater to form the lower nozzle, forming a first sacrificial layer within the lower nozzle, forming a second sacrificial layer for forming the upper nozzle on the first sacrificial layer in a tapered shape, forming the heat dissipating layer on the passivation layers by electroplating, and removing the second sacrificial layer and the first sacrificial layer to form a nozzle having the lower nozzle and the upper nozzle.

The lower nozzle may be formed in a cylindrical shape by dry etching the passivation layers using reactive ion etching (RIE).

The first and second sacrificial layers may be made from photoresist.

Preferably, forming the second sacrificial layer includes incliningly patterning the photoresist by a proximity exposure for exposing the photoresist using a photomask which is inclined to be separated from a surface of the photoresist by a predetermined distance.

An inclination of the second sacrificial layer may be adjusted by a space between the photomask and the photoresist and an exposure energy.

In addition, the method may further include forming a seed layer for electroplating of the heat dissipating layer on the first sacrificial layer and the passivation layers, prior to formation of the second sacrificial layer.

It is preferable that after forming the seed layer for electroplating of the heat dissipating layer on the passivation layers, the first sacrificial layer and the second sacrificial layer are formed integrally with each other.

The heat dissipating layer may be made of any one of transition element metals of including nickel and gold and is preferably formed to a thickness of 10–50 μm.

After forming the heat dissipating layer, planarizing an upper surface of the heat dissipating layer by chemical mechanical polishing (CMP).

The formation of the lower nozzle may include anisotropically etching the passivation layers and the substrate within an area of the heater to form a hole of a predetermined depth; depositing a predetermined material layer on an inner surface of the hole; and etching the material layer formed at a bottom of the hole to expose the substrate while at the same time forming a nozzle guide made of the material layer for defining the lower nozzle along a sidewall of the hole.

It is preferable that (d) includes etching the substrate exposed through the nozzle to form the ink chamber, etching a rear surface of the substrate to form the manifold, and forming the ink channel by etching the substrate so that it penetrates the substrate between the manifold and the ink chamber.

According to the method of the present invention, since the nozzle plate having the tapered nozzle is formed integrally with the substrate having the ink chamber and the ink channel formed thereon, the ink-jet printhead can be manufactured on a single wafer using a single process.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF THE INVENTION

Figure 1A:
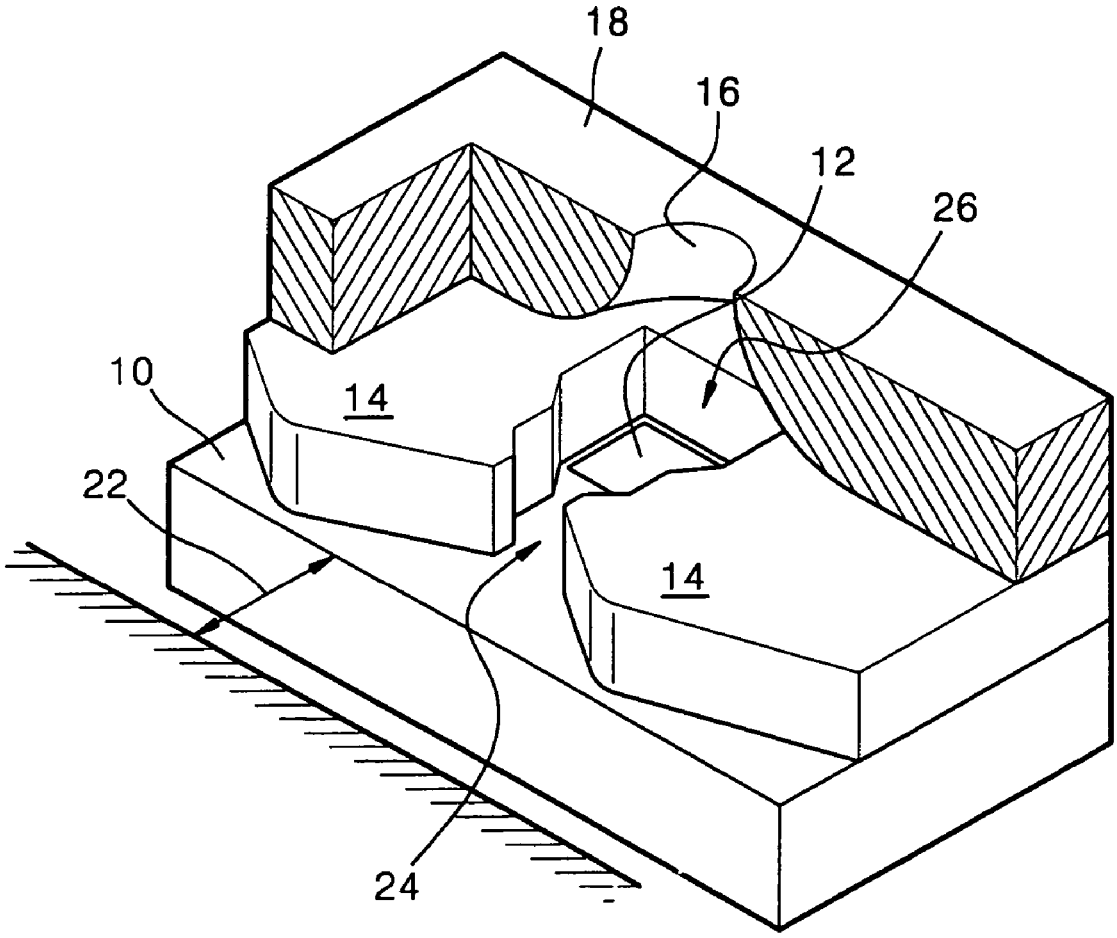
FIG. 1A (PRIOR ART)
FIGS. 1A and 1B illustrate a partial cross-sectional perspective view of a conventional thermally driven ink-jet printhead and a cross-sectional view for explaining a process of ejecting an ink droplet, respectively.
Figure 1B:
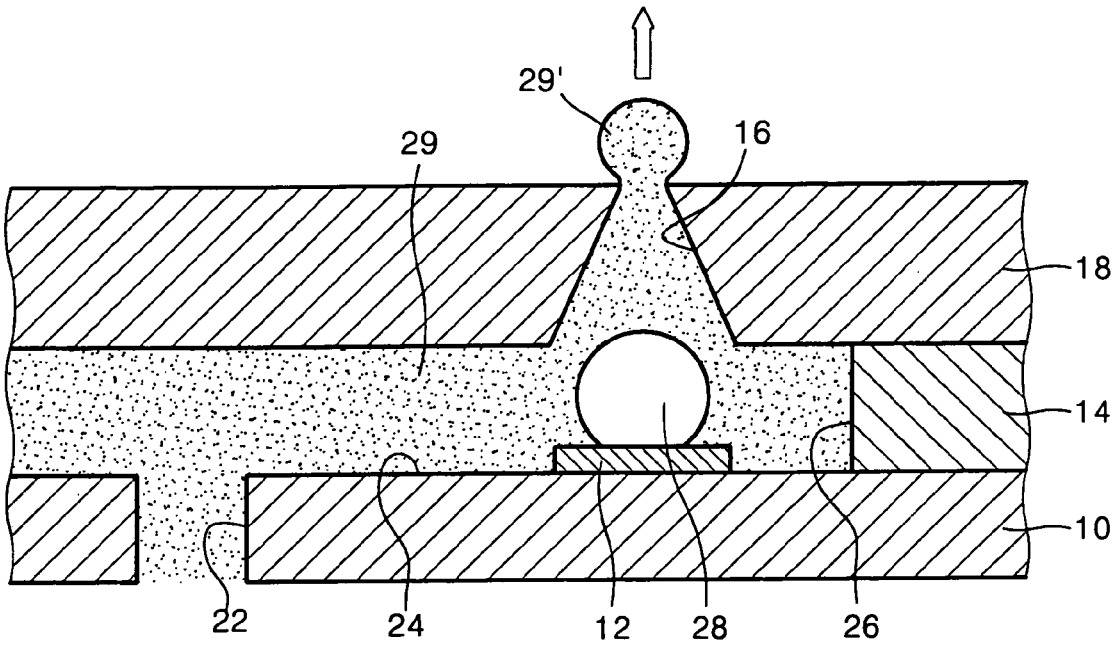
FIG. 1B (PRIOR ART)
Figure 2A:
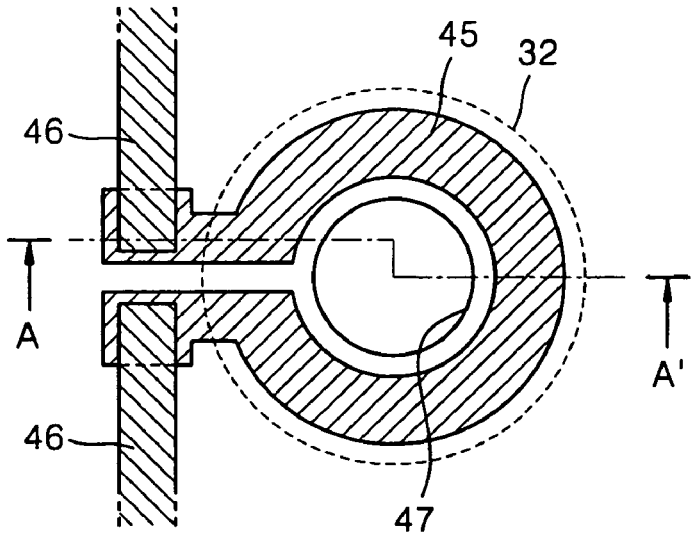
FIG. 2A (PRIOR ART)
FIGS. 2A and 2B illustrate a plan view showing an example of a conventional monolithic ink-jet printhead and a vertical cross-sectional view taken along line A–A' of FIG. 2A, respectively.
Figure 2B:
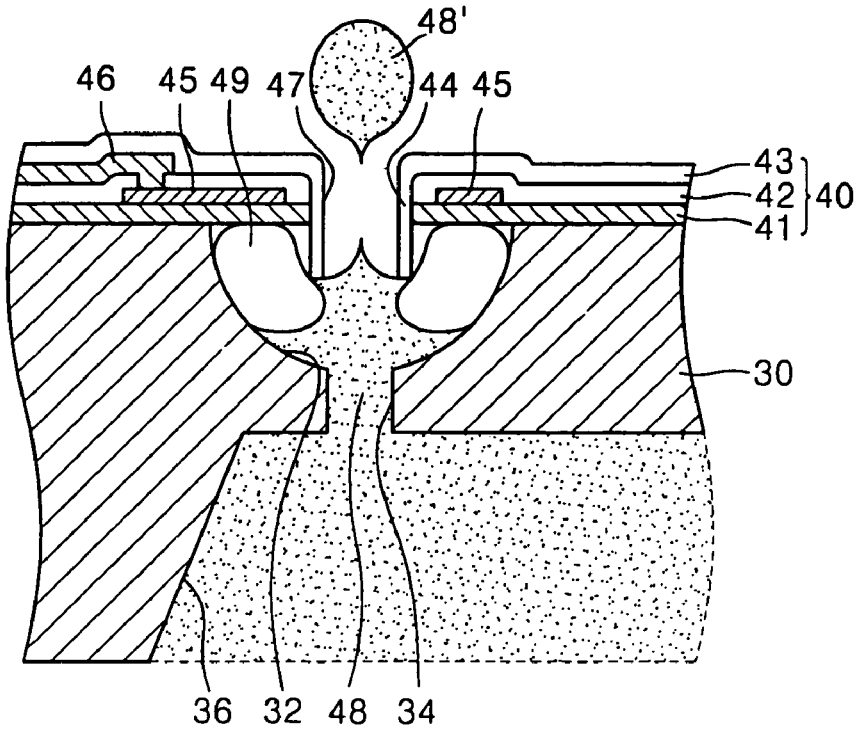
FIG. 2B (PRIOR ART)

Korean Patent Application No. 2002-64344, filed on Oct. 21, 2002, and entitled: "Monolithic Ink-Jet Printhead Having a Tapered Nozzle and Method for Manufacturing the Same," is incorporated by reference herein in its entirety.

The present invention will now be described more fully hereinafter with reference to the accompanying drawings, in which preferred embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions and the sizes of components may be exaggerated for clarity. It will also be understood that when a layer is referred to as being "on" another layer or substrate, it can be directly on the other layer or substrate, or intervening layers may also be present. Like reference numerals refer to like elements throughout.

Figure 3:
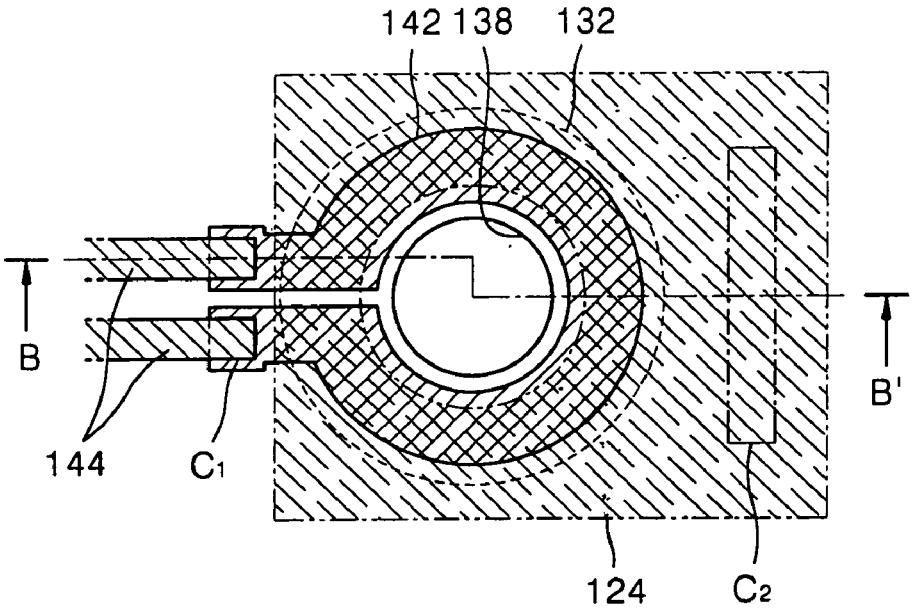
FIG. 3 illustrates a planar structure of a monolithic ink-jet printhead according to a preferred embodiment of the present invention.
Figure 4:
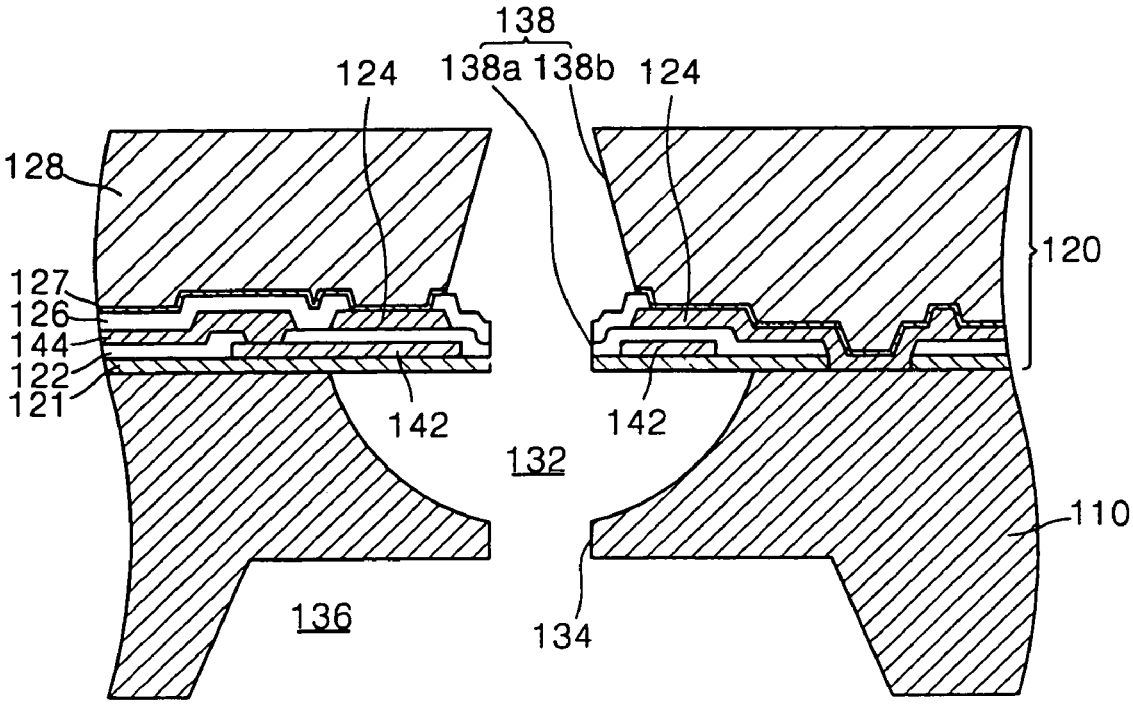
FIG. 4 illustrates a vertical cross-sectional view of the ink-jet printhead of the present invention taken along line B–B' of FIG. 3.

FIG. 3 illustrates a planar structure of a monolithic ink-jet printhead according to a preferred embodiment of the present invention. FIG. 4 illustrates a vertical cross-sectional view of the ink-jet printhead of FIG. 3 taken along line B–B' of FIG. 3.

Referring to FIGS. 3 and 4, an ink chamber 132 to be supplied with ink to be ejected, a manifold 136 for supplying ink to the ink chamber 132, and an ink channel 134 for connecting the ink chamber 132 with the manifold 136 are formed on a substrate 110 of an ink-jet printhead.

Here, a silicon wafer widely used to manufacture integrated circuits (ICs) may be used as the substrate 110. The ink chamber 132 is preferably formed in a substantially hemispherical shape having a predetermined depth on a front surface, i.e., an upper surface, of the substrate 110. The manifold 136 is preferably formed on a rear surface, i.e., a lower surface, of the substrate 110 to be positioned under the ink chamber 132 and is connected to an ink reservoir (not shown) for storing ink.

Although only a unit structure of the ink-jet printhead has been shown in the drawings, a plurality of ink chambers 132 are arranged on the manifold 136 in one or two rows, or in three or more rows to achieve a higher resolution in an ink-jet printhead manufactured in a chip state.

The ink channel 134, which is in communication with the ink chamber 132 and the manifold 136, is formed by perpendicularly penetrating the substrate 110. The ink channel 134 is formed in a central portion of the bottom surface of the ink chamber 132. A cross-sectional shape of the ink channel is preferably circular. However, the ink channel 134 may have various cross-sectional shapes such as oval or polygonal one.

A nozzle plate 120 is formed on the substrate 110 having the ink chamber 132, the ink channel 134, and the manifold 136 formed thereon. The nozzle plate 120 forming an upper wall of the ink chamber 132 has a nozzle 138, through which ink is ejected, at a location corresponding to a center of the ink chamber 132 by perpendicularly penetrating the nozzle plate 120.

The nozzle plate 120 includes a plurality of material layers stacked on the substrate 110. The plurality of material layers includes first and second passivation layers 121 and 122, a heat conductive layer 124, a third passivation layer 126, and a heat dissipating layer 128 made of a metal. A heater 142 is provided between the first and second passivation layers 121 and 122, and a conductor 144 is provided between the second and third passivation layers 122 and 126.

The first passivation layer 121, the lowermost layer among the plurality of material layers forming the nozzle plate 120, is formed on an upper surface of the substrate 110. The first passivation layer 121 provides electrical insulation between the overlying heater 142 and the underlying substrate 110 and protection of the heater 142. The first passivation layer 121 may be made of silicon oxide or silicon nitride.

The heater 142 overlying the first passivation layer 121 and located above the ink chamber 132 for heating ink within the ink chamber 132 is formed around the nozzle 138. The heater 142 is made from a resistive heating material, such as polysilicon doped with impurities, silicide, tantalum-aluminum alloy, titanium nitride, and tantalum nitride.

The second passivation layer 122 is formed on the first passivation layer 121 and the heater 142 for providing insulation between the overlying heat conductive layer 124 and the underlying heater 142 as well as protection of the heater 142. Similarly to the first passivation layer 121, the second passivation layer 122 may be made of silicon nitride or silicon oxide.

The conductor 144 electrically connected to the heater 142 for applying a pulse current to the heater 142 is formed on the second passivation layer 122. While a first end of the conductor 144 is connected to the heater 142 through a first contact hole $C_1$ formed in the second passivation layer 122, a second end is electrically connected to a bonding pad (not shown). The conductor 144 may be made of a highly conductive metal such as aluminum or aluminum alloy.

The heat conductive layer 124 may be provided above the second passivation layer 122. The heat conductive layer 124 functions to conduct heat from the heater 142 to the substrate 110 and the heat dissipating layer 128 which will be described later. The heat conductive layer 124 is preferably formed as widely as possible to cover the ink chamber 132 and the heater 142 entirely. The heat conductive layer 124 needs to be separated from the conductor 144 by a predetermined distance for insulation purpose. The insulation between the heat conductive layer 124 and the heater 142 can be achieved by the second passivation layer 122 interposed therebetween. Furthermore, the heat conductive layer 124 contacts the upper surface of the substrate 110 through a second contact hole $C_2$ formed by penetrating the first and second passivation layers 121 and 122.

The heat conductive layer 124 is made of a metal having good conductivity. When both heat conductive layer 124 and the conductor 144 are formed on the second passivation layer 122, the heat conductive layer 124 may be made of the same material as the conductor 144, such as aluminum or aluminum alloy.

If the heat conductive layer 124 is to be formed thicker than the conductor 144 or made of a metal different from that of the conductor 144, an insulating layer (not shown) may be interposed between the conductor 144 and the heat conductive layer 124.

The third passivation layer 126 is provided on the conductor 144 and the second passivation layer 122. The third passivation layer 126 may be made of tetraethylorthosilicate (TEOS) oxide or silicon oxide. It is desirable to avoid forming the third passivation layer 126 over the heat conductive layer 124 to avoid contacting the heat conductive layer 124 and the heat dissipating layer 128.

The heat dissipating layer 128, the uppermost layer among the plurality of material layers forming the nozzle plate 120, is made of a transition element metal having high thermal conductivity, such as nickel or gold. The heat dissipating layer 128 is formed to a thickness of between about 10–50 μm by electroplating the metal on the third passivation layer 126 and the heat conductive layer 124. To accomplish this formation, a seed layer 127 for electroplating the metal is provided on the third passivation layer 126 and the heat conductive layer 124. The seed layer 127 may be made of a metal having good electric conductivity such as chrome or copper.

Since the heat dissipating layer 128 made of a metal as described above is formed by an electroplating process, it can be formed relatively thick and integrally with other components of the ink-jet printhead. Thus, heat sinking through the heat dissipating layer 128 can be achieved effectively, and the nozzle 138 having a relatively long length, which will be described later, may be formed. As described above, a deposition process makes it difficult to form a thick material layer so that the deposition process must be repeated several times.

The heat dissipating layer 128 functions to dissipate the heat from the heater 142 or from around the heater 142. That is, the heat residing in or around the heater 142 after ink ejection is transferred to the substrate 110 and the heat dissipating layer 128 via the heat conductive layer 124 and then dissipated. This configuration facilitates quick heat dissipation after ink ejection and lowers the temperature around the nozzle 138, thereby providing a stable printing at a high operating frequency.

The nozzle 138, through which ink is ejected from the ink chamber 132 is formed by penetrating the nozzle plate 120. The nozzle 138 includes a lower nozzle **138*a* formed on the first, second, and third passivation layers 121, 122, and 126 and an upper nozzle 138*b* formed on the heat dissipating layer 128. While the lower nozzle 138*a* has a cylindrical shape, the upper nozzle 138*b*** has a tapered shape in which a cross-sectional area thereof decreases gradually toward an exit.

Since the upper nozzle **138*b* is formed on the relatively thick heat dissipating layer 128 as described above, the overall length of the nozzle 138 can be sufficiently provided. Thus, the directionality of the ink droplet ejected through the nozzle 138 is improved. That is, the ink droplet can be ejected in a direction exactly perpendicular to the substrate 110**.

Since the upper nozzle 138*b* has the tapered shape, a fluid resistance is reduced so that an ejection speed of the ink droplet increases. Specifically, a resistance against fluid flowing through a channel is determined by a cross-sectional shape of the channel. More particularly, this resistance is inversely proportional to the fourth power of a radius of the channel. Thus, while a radius of the exit of the upper nozzle 138*b* for determining the amount of the ink ejection is fixed, a radius toward an entrance of the upper nozzle 138*b* gradually increases. As a result, the upper nozzle 138*b* is formed in the tapered shape in which a cross-sectional area thereof decreases gradually toward the exit of the nozzle 138. Thus, since the fluid resistance within the upper nozzle 138*b* is reduced so that the ejection speed of the ink droplet increases, an operating frequency of the ink-jet printhead according to the present invention can also be increased.

Figure 5:
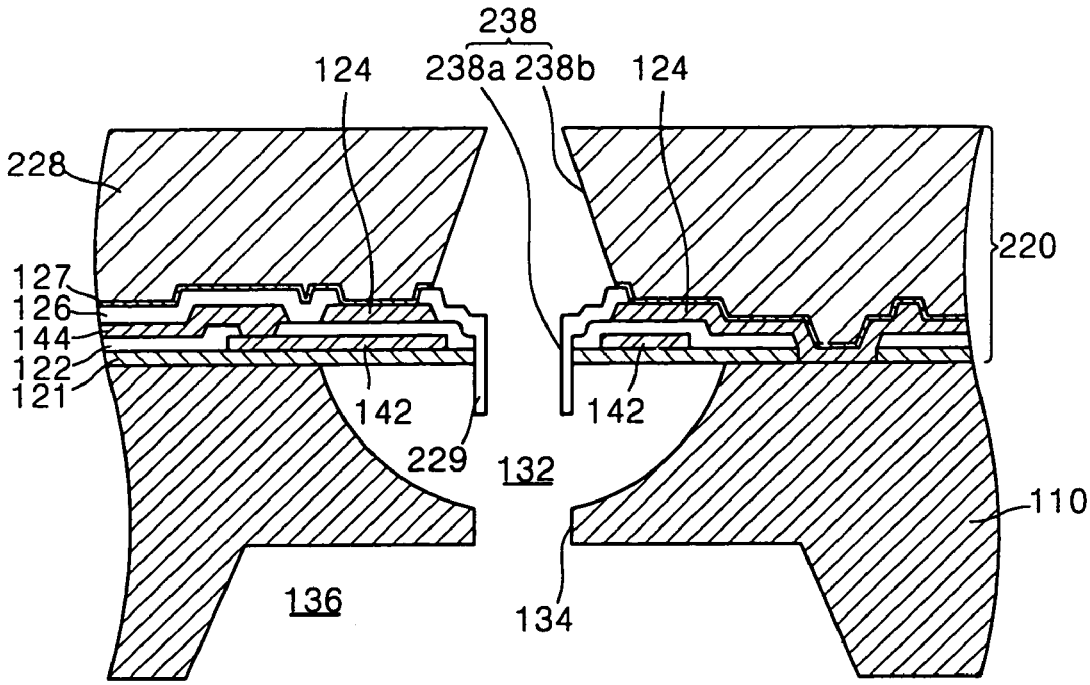
FIG. 5 illustrates a vertical cross-sectional view of a modified example of a nozzle plate shown in FIG. 4.

FIG. 5 illustrates a vertical cross-sectional view of a modified example of the nozzle plate shown in FIG. 4. In FIG. 5, the same reference numerals as in FIG. 4 represent the same elements, and thus descriptions thereof will be omitted.

Referring to FIG. 5, a nozzle 238 formed in a nozzle plate 220 includes a lower nozzle 238*a* having a cylindrical shape formed in the first, second, and third passivation layers 121, 122, and 126, and an upper nozzle 238*b* having a tapered shape formed in a heat dissipating layer 228. A nozzle guide 229 extends a predetermined length down the lower nozzle 238*a* and into the ink chamber 132.

In this way, the nozzle guide 229 acts to lengthen the overall length of the nozzle 238, thereby improving the directionality of an ink droplet to be ejected through the nozzle 238. However, this may not only limit the expansion of bubbles but may also complicate the manufacturing process.

An ink ejection mechanism for an ink-jet printhead according to the present invention will now be described with references to FIGS. 6A through 6C.

Figure 6A:
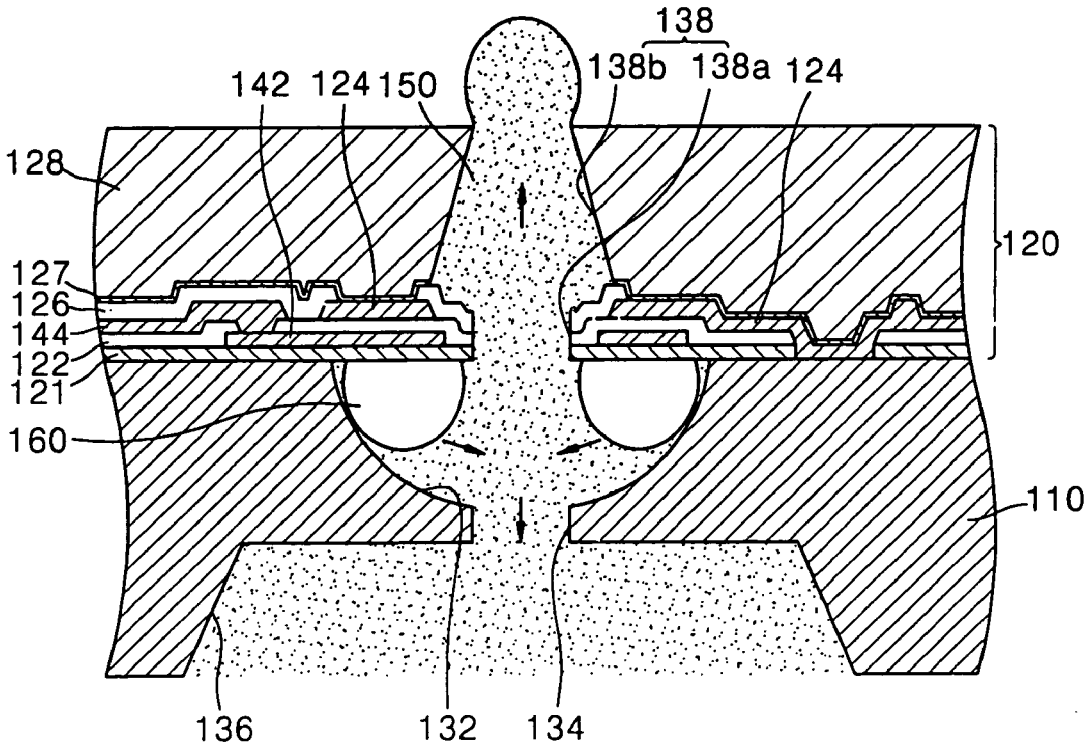
FIGS. 6A through 6C illustrate an ink ejection mechanism in an ink-jet printhead according to an embodiment of the present invention.

Referring to FIG. 6A, if a pulse current is applied to the heater 142 through the conductor 144 when the ink chamber 132 and the nozzle 138 are filled with ink 150, heat is generated by the heater 142. The generated heat is transferred through the first passivation layer 121 underlying the heater 142 to the ink 150 within the ink chamber 132 so that the ink 150 boils to form bubbles 160. As the bubbles 160 expand upon a continuous supply of heat, the ink 150 within the nozzle 138 is ejected out of the nozzle 138. At this time, since the upper nozzle 138*b* has a tapered shape, the flow speed of the ink 150 becomes quicker.

Figure 6B:
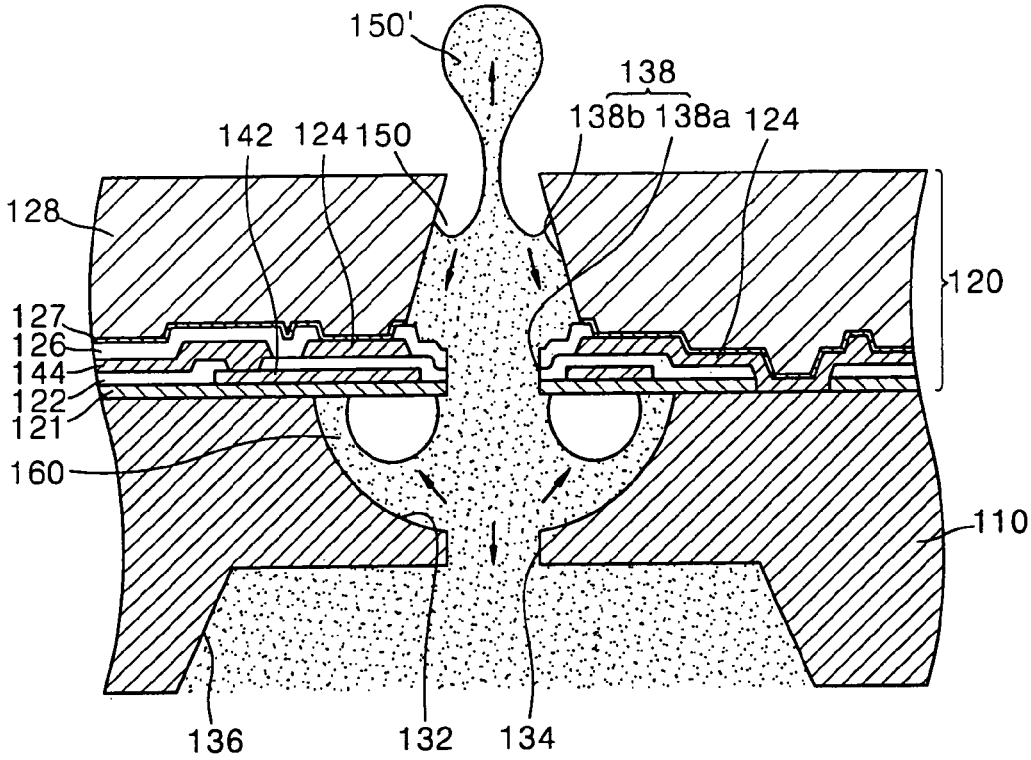

Referring to FIG. 6B, if the applied pulse current is interrupted when the bubble 160 expands to a maximum size thereof, the bubble 160 then shrinks until it collapses completely. At this time, a negative pressure is formed in the ink chamber 132 so that the ink 150 within the nozzle 138 returns to the ink chamber 132. At the same time, a portion of the ink 150 being pushed out of the nozzle 138 is separated from the ink 150 within the nozzle 138 and ejected in the form of an ink droplet 150' due to an inertial force.

A meniscus in the surface of the ink 150 formed within the nozzle 138 retreats toward the ink chamber 132 after the separation of the ink droplet 150'. In this arrangement, the nozzle 138 is sufficiently long due to the thick nozzle plate 120 so that the meniscus retreats only within the nozzle 138 and not into the ink chamber 132. Thus, this prevents air from flowing into the ink chamber 132 while quickly restoring the meniscus to an original state, thereby stably maintaining high speed ejection of the ink droplet 150'. Further, since heat residing in or around the heater 142 after the separation of the ink droplet 150' passes through the heat conductive layer 124 and the heat dissipating layer 128 and is dissipated into the substrate 110, the temperature in or around the heater 142 and the nozzle 138 drops more even rapidly.

Figure 6C:
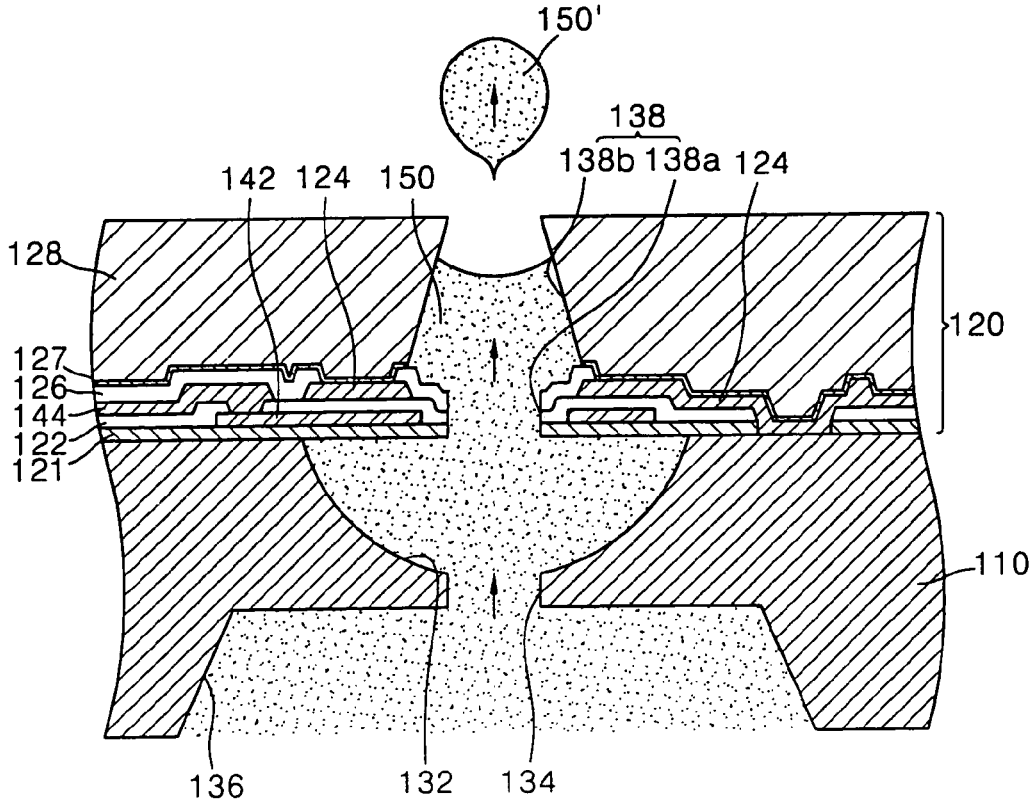

Next, referring to FIG. 6C, as the negative pressure within the ink chamber 132 disappears, the ink 150 again flows toward the exit of the nozzle 138 due to a surface tension force acting at the meniscus formed in the nozzle 138. Since the upper nozzle 138*b* has the tapered shape, the speed at which the ink 150 flows upward further increases. The ink 150 is then supplied through the ink channel 134 to refill the ink chamber 132. When the refill of the ink 150 is completed so that the printhead returns to the initial state, the ink ejection mechanism is repeated. During the above process, the printhead can thermally recover the original state thereof more quickly because of heat dissipation through the heat conductive layer 124 and heat dissipating layer 128.

A method for manufacturing a monolithic ink-jet printhead as presented above according to a preferred embodiment of the present invention will now be described.

FIGS. 7 through 17 illustrate cross-sectional views for explaining stages in a method for manufacturing of the monolithic ink-jet printhead having the nozzle plate shown in FIG. 4 according to a preferred embodiment of the present invention.

Figure 7:
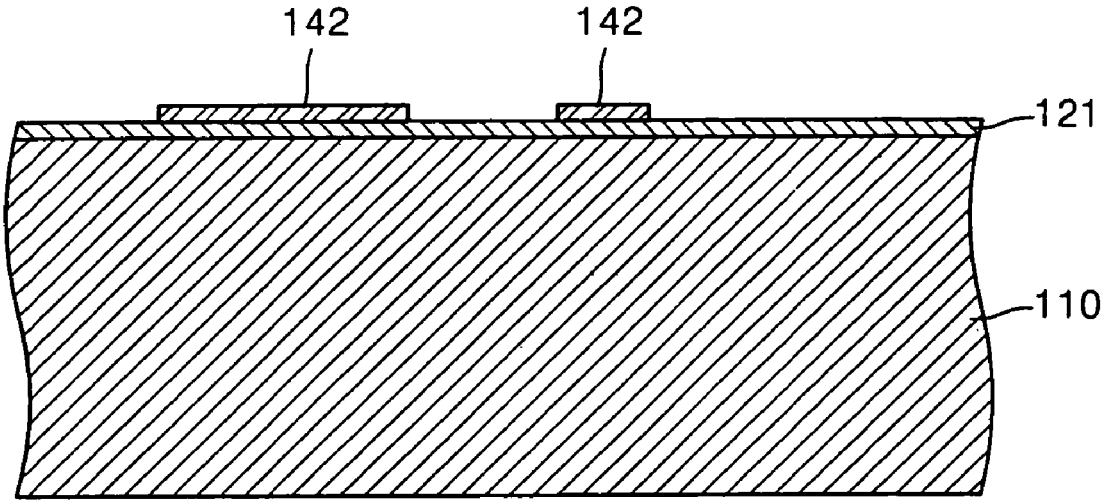
FIGS. 7 through 17 illustrate cross-sectional views for explaining stages in a method for manufacturing the ink-jet printhead shown in FIG. 4 according to a preferred embodiment of the present invention.

Referring to FIG. 7, a silicon wafer used for the substrate 110 has been processed to have a thickness of approximately 300–500 μm. The silicon wafer is widely used for manufacturing semiconductor devices and effective for mass production.

While FIG. 7 shows a very small portion of the silicon wafer, the ink-jet printhead according to the present invention can be manufactured in tens to hundreds of chips on a single wafer.

The first passivation layer 121 is formed on an upper surface of the prepared silicon substrate 110. The first passivation layer 121 may be formed by depositing silicon oxide or silicon nitride on the upper surface of the substrate 110.

Next, the heater 142 is formed on the first passivation layer 121 on the upper surface of the substrate 110. The heater 142 may be formed by depositing a resistive heating material, such as polysilicon doped with impurities, silicide, tantalum-aluminum alloy, titanium nitride or tantalum nitride, on the entire surface of the first passivation layer 121 to a predetermined thickness and then patterning the same. Specifically, while the polysilicon doped with impurities, such as a phosphorus (P)-containing source gas, may be deposited by low-pressure chemical vapor deposition (LPCVD) to a thickness of about 0.5–2 μm, tantalum-aluminum alloy or tantalum nitride may be deposited by sputtering to a thickness of about 0.1–0.3 μm. The deposition thickness of the resistive heating material may be determined in a range other than that given here to have an appropriate resistance considering the width and length of the heater 142. The resistive heating material is deposited on the entire surface of the first passivation layer 121 and then patterned by a photo process using a photomask and a photoresist and an etching process using a photoresist pattern as an etch mask.

Figure 8:
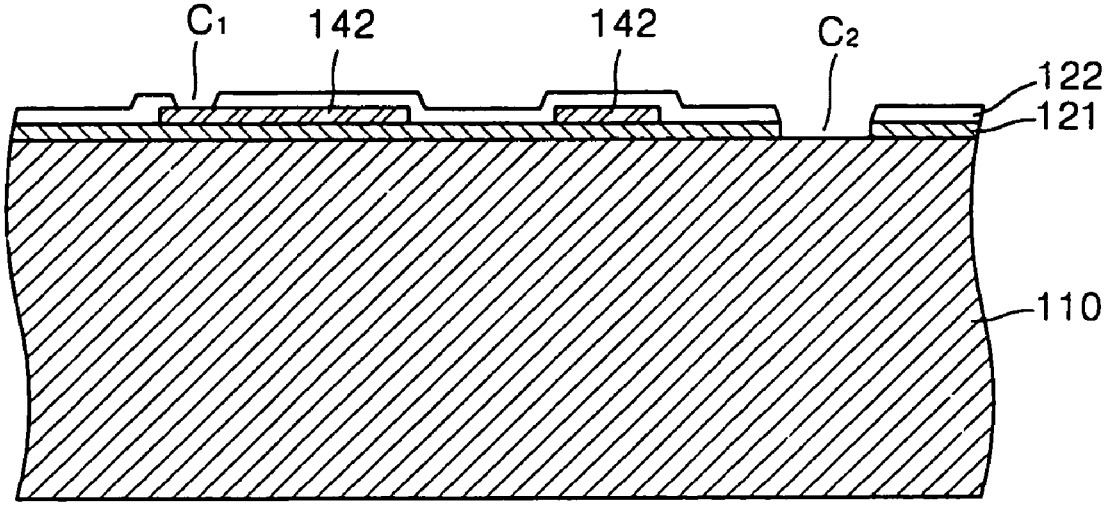

Subsequently, as shown in FIG. 8, the second passivation layer 122 is formed on the first passivation layer 121 and the heater 142 by depositing silicon oxide or silicon nitride to a thickness of about 1–3 μm. The second passivation layer 122 is then partially etched to form the first contact hole $C_1$ exposing a portion of the heater 142 to be connected with the conductor 144 in a step shown in FIG. 9. In addition, the second and first passivation layers 122 and 121 are sequentially etched to form the second contact hole $C_2$ exposing a portion of the substrate 110 to contact the heat conductive layer 124 in the step also shown in FIG. 9. The first and second contact holes $C_1$ and $C_2$ can be formed simultaneously.

Figure 9:
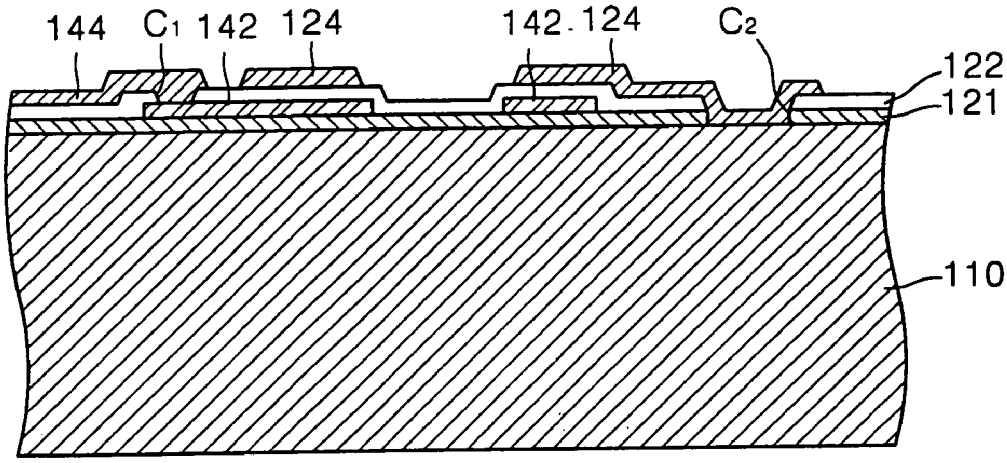

FIG. 9 shows the state in which the conductor 144 and the heat conductive layer 124 have been formed on the upper surface of the second passivation layer 122. Specifically, the conductor 144 and the heat conductive layer 124 can be formed at the same time by depositing a metal having excellent electric and thermal conductivity, such as aluminum or aluminum alloy, using a sputtering method to a thickness of about 1 μm and then patterning the same. At this time, the conductor 144 and the heat conductive layer 124 are formed insulated from each other, so that the conductor 144 is connected to the heater 142 through the first contact hole $C_1$ and the heat conductive layer 124 contacts the substrate 110 through the second contact hole $C_2$.

Meanwhile, if the heat conductive layer 124 is to be formed thicker than the conductor 144 or if the heat conductive layer 124 is to be made of a metal different from the metal forming the conductor 144, or to further ensure insulation between the conductor 144 and heat conductive layer 124, the heat conductive layer 124 may be formed after the formation of the conductor 144. More specifically, in the step shown in FIG. 8, after forming only the first contact hole $C_1$, the conductor 144 is formed. An insulating layer (not shown) is then formed on the conductor 144 and the second passivation layer 122. The insulating layer can be formed from the same material using the same method as the second passivation layer 122. The insulating layer and the second and first passivation layers 122 and 121 are then sequentially etched to form the second contact hole $C_2$. Thus, the insulating layer is interposed between the conductor 144 and the heat conductive layer 124.

Figure 10:
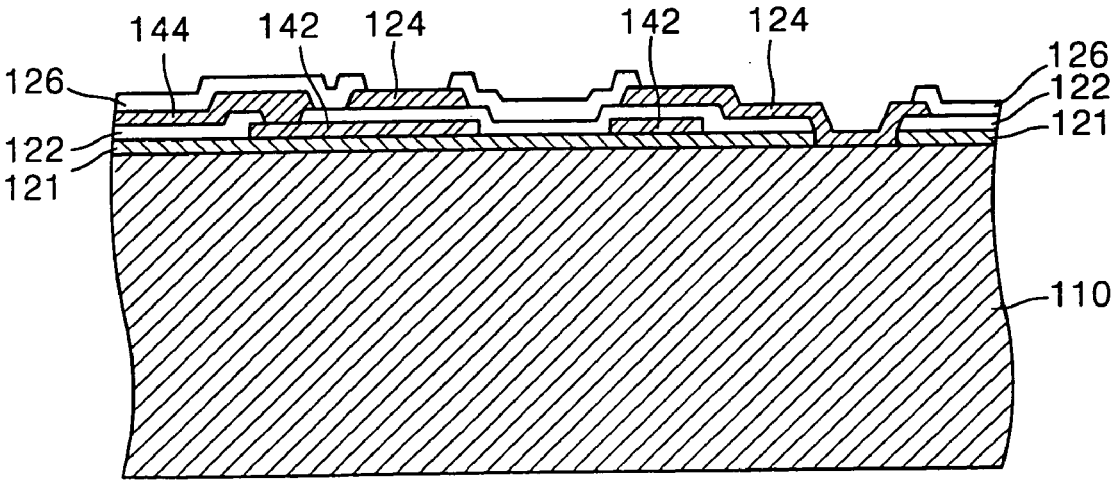

FIG. 10 shows the state in which the third passivation layer 126 has been formed on the entire surface of the resultant structure of FIG. 9. Specifically, the third passivation layer 126 may be formed by depositing tetraethylorthosilicate (TEOS) oxide using plasma enhanced chemical vapor deposition (PECVD) to a thickness of approximately 0.7–1 μm. Then, the third passivation layer 126 is partially etched to expose the heat conductive layer 124.

Figure 11:
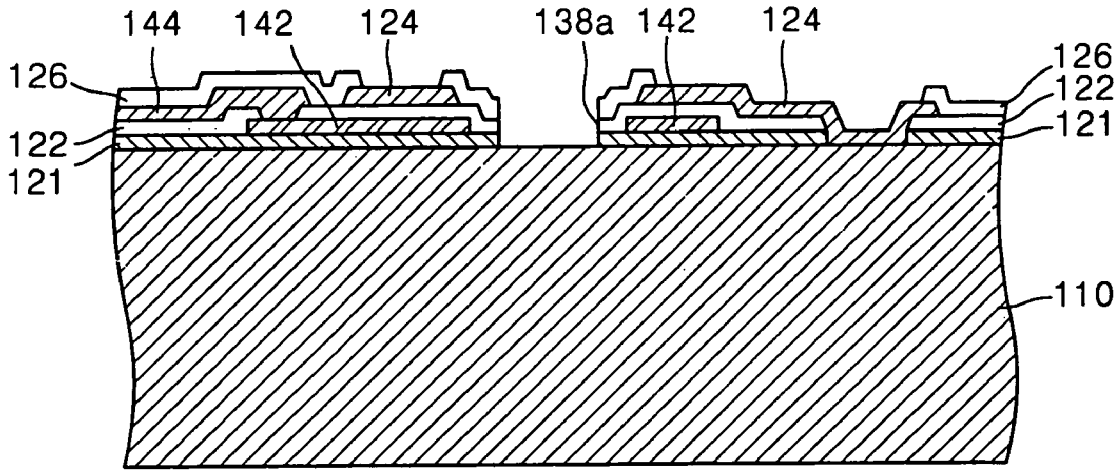

FIG. 11 shows the state in which the lower nozzle 138*a* has been formed. The lower nozzle 138*a* is formed by sequentially etching the third, second, and first passivation layers 126, 122, and 121 within the heater 142 to a diameter of about 16–40 μm using a reactive ion etching (RIE).

Figure 12:
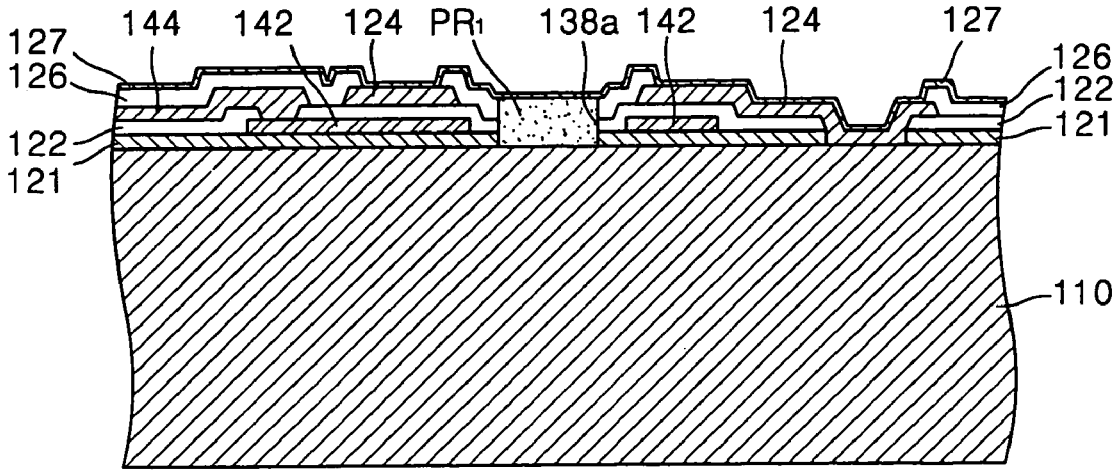

As shown in FIG. 12, a first sacrificial layer $PR_1$ is then formed within the lower nozzle 138*a*. Specifically, a photoresist is applied to the entire surface of the resultant structure of FIG. 11 and patterned to leave only the photoresist filled in the lower nozzle 138*a*. The residual photoresist is used to form the first sacrificial layer $PR_1$, thereby maintaining the shape of the lower nozzle 138*a* during the subsequent steps. Then, a seed layer 127 is formed for electroplating over the entire surface of the resulting structure formed after formation of the first sacrificial layer $PR_1$. To perform the electroplating, the seed layer 127 can be formed by depositing metal having good conductivity, such as chrome (Cr) or copper (Cu), to a thickness of approximately 500–2,000 Å using a sputtering method.

Figure 13:
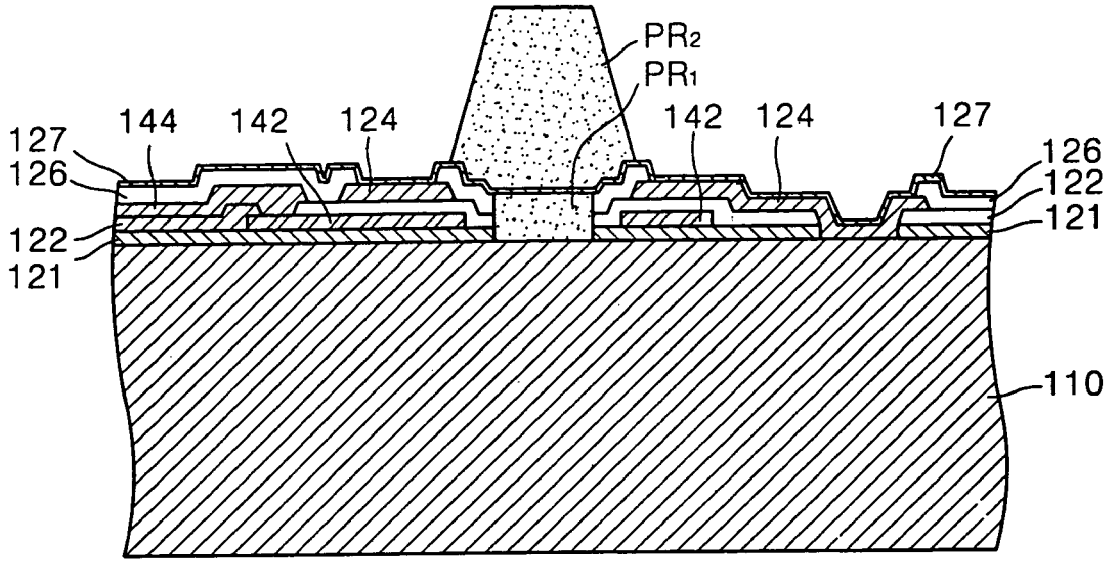

FIG. 13 shows the state in which a second sacrificial layer $PR_2$ for forming the upper nozzle 138*b* has been formed. Specifically, a photoresist is applied to the entire surface of the seed layer 127 and patterned to leave the photoresist only in a portion where the upper nozzle (138*b* of FIG. 15) is to be formed. The residual photoresist is formed in a tapered shape having a cross-sectional area thereof that decreases toward the top and acts as the second sacrificial layer $PR_2$ for forming the upper nozzle 138*b* in the subsequent steps. At this time, the second sacrificial layer $PR_2$ of the tapered shape can be formed by a proximity exposure process for exposing the photoresist using a photomask which is separated from a surface of the photoresist by a predetermined distance. In this case, light passed through the photomask is diffracted so that a boundary surface between an exposed area and a non-exposed area of the photoresist is inclined. Inclination of the second sacrificial layer $PR_2$ can be adjusted by varying a space between the photomask and the photoresist and/or an exposure energy in the proximity exposure process.

Figure 14:
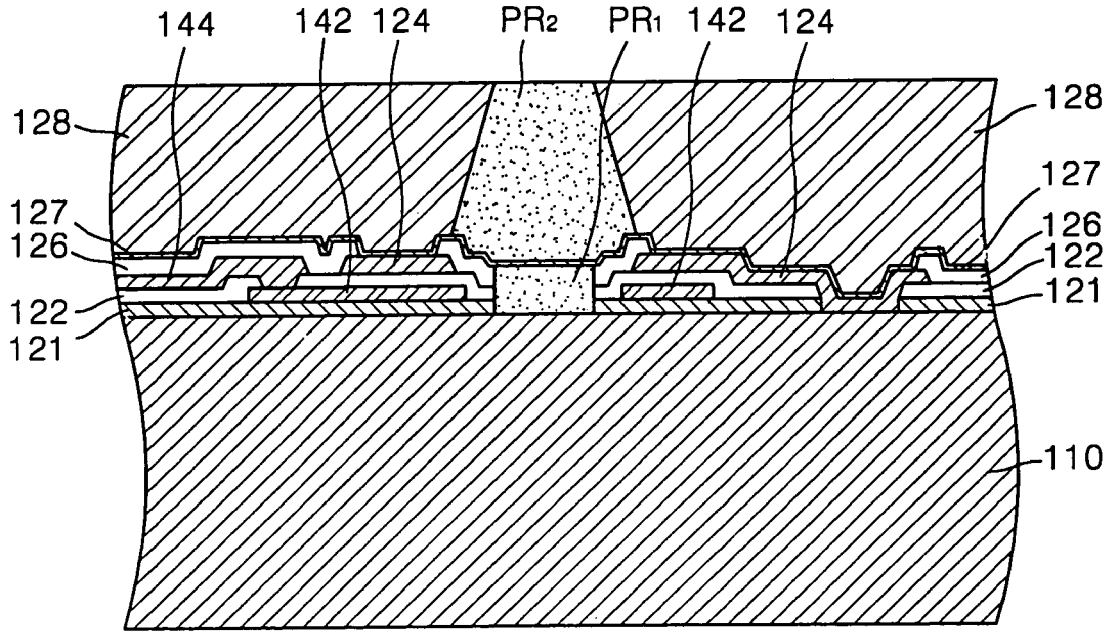

Next, as shown in FIG. 14, the heat dissipating layer 128 is formed from a metal of a predetermined thickness on an upper surface of the seed layer 127. The heat dissipating layer 128 can be formed to a thickness of about 10–50 μm by electroplating a transition element metal, such as nickel (Ni) or gold (Au), on the surface of the seed layer 127. The electroplating process is completed when the heat dissipating layer 128 is formed to a desired height at which the exit cross-sectional area of the upper nozzle 138*b* is formed, the height being less than that of the second sacrificial layer $PR_2$. The thickness of the heat dissipating layer 128 may be appropriately determined considering the cross-sectional area and the length of the upper nozzle 138*b*.

The surface of the heat dissipating layer 128 that has undergone electroplating has irregularities due to the underlying material layers. Thus, the surface of the heat dissipating layer 128 may be planarized by chemical mechanical polishing (CMP).

Figure 15:
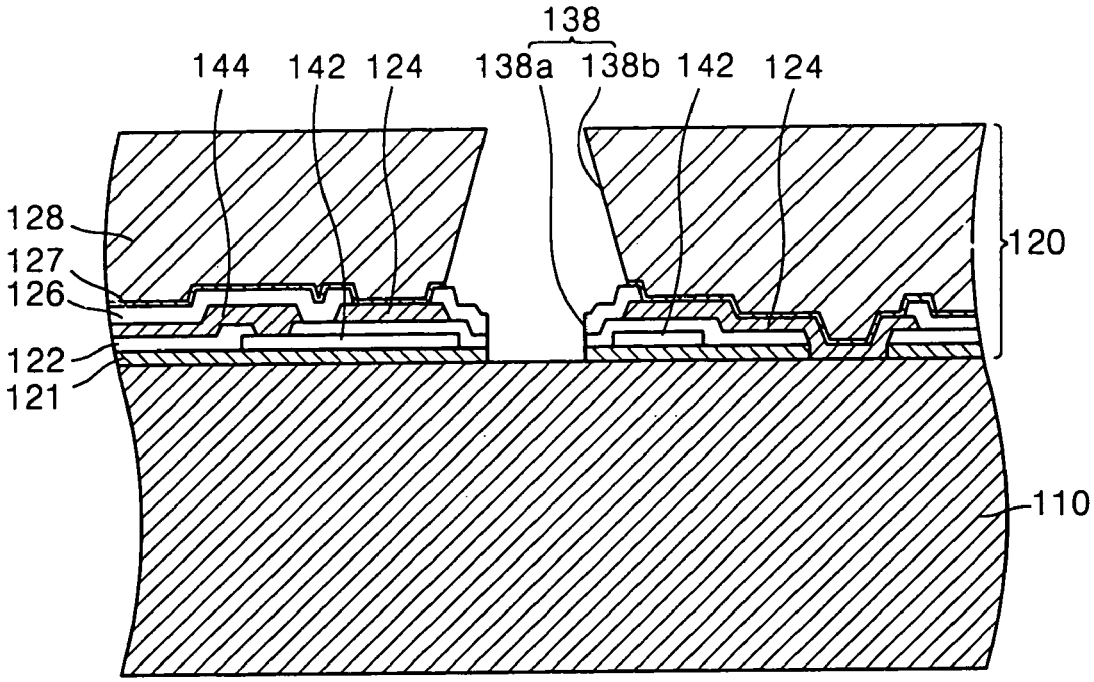

The second sacrificial layer $PR_2$ for forming the upper nozzle 138*b*, the underlying seed layer 127, and the first sacrificial layer $PR_1$ for maintaining the lower nozzle 138*a* are then sequentially etched. As shown in FIG. 15, the complete nozzle 138 is formed by connecting the lower nozzle 138*a* having the cylindrical shape with the upper nozzle 138*b* having the tapered shape, and the nozzle plate 120 stacking the plurality of material layers is completed.

Alternatively, the nozzle 138 and the heat dissipating layer 128 may be formed through the following steps. In the step shown in FIG. 12, the seed layer 127 for electroplating is formed on the entire surface of the resulting structure of FIG. 11 before forming the first sacrificial layer $PR_1$. The first sacrificial layer $PR_1$ and the second sacrificial layer $PR_2$ for forming the upper nozzle 138*b* are then sequentially and integrally formed. Next, the heat dissipating layer 128 is formed as shown in FIG. 14, followed by planarization of the surface of the heating dissipating layer 128 by CMP. After the planarization, the second and first sacrificial layers $PR_2$ and $PR_1$, and the seed layer 127 under the first sacrificial layer $PR_1$ are etched to form the nozzle 138 and the nozzle plate 120 as shown in FIG. 15.

Figure 16:
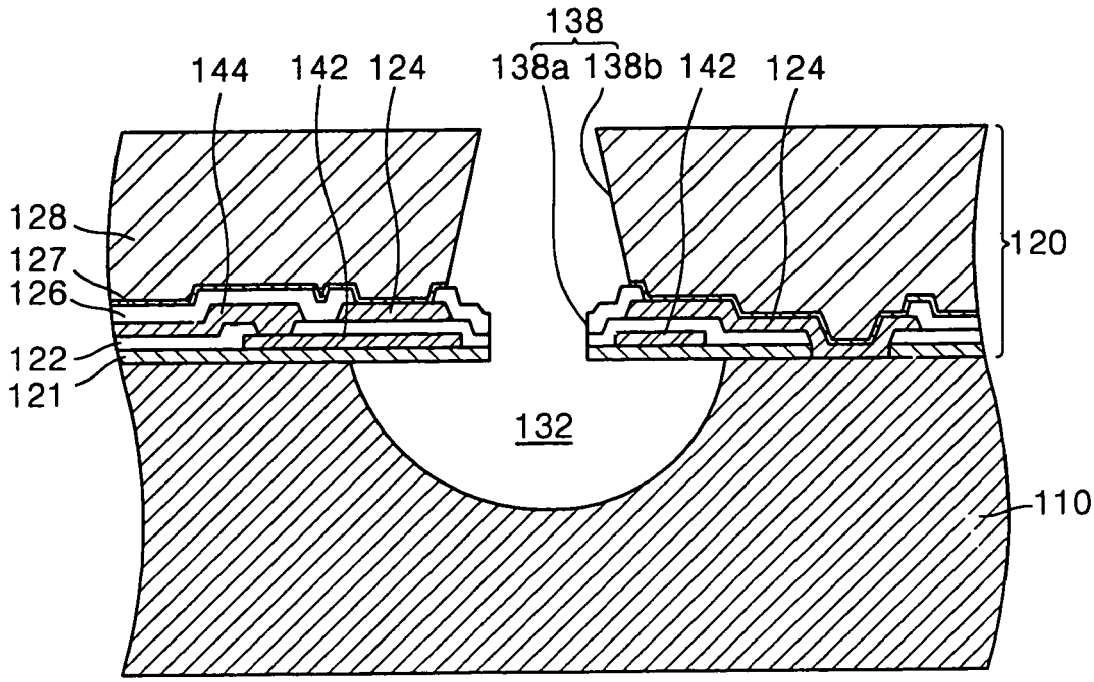

FIG. 16 shows the state in which the ink chamber 132 of a predetermined depth has been formed on the front surface of the substrate 110. The ink chamber 132 can be formed by isotropically etching the substrate 110 exposed by the nozzle 138. Specifically, dry etching is carried out on the substrate 110 using $XeF_2$ gas or $BrF_3$ gas as an etch gas for a predetermined time to form the hemispherical ink chamber 132 with a depth and a radius of about 20–40 μm as shown in FIG. 16.

Figure 17:
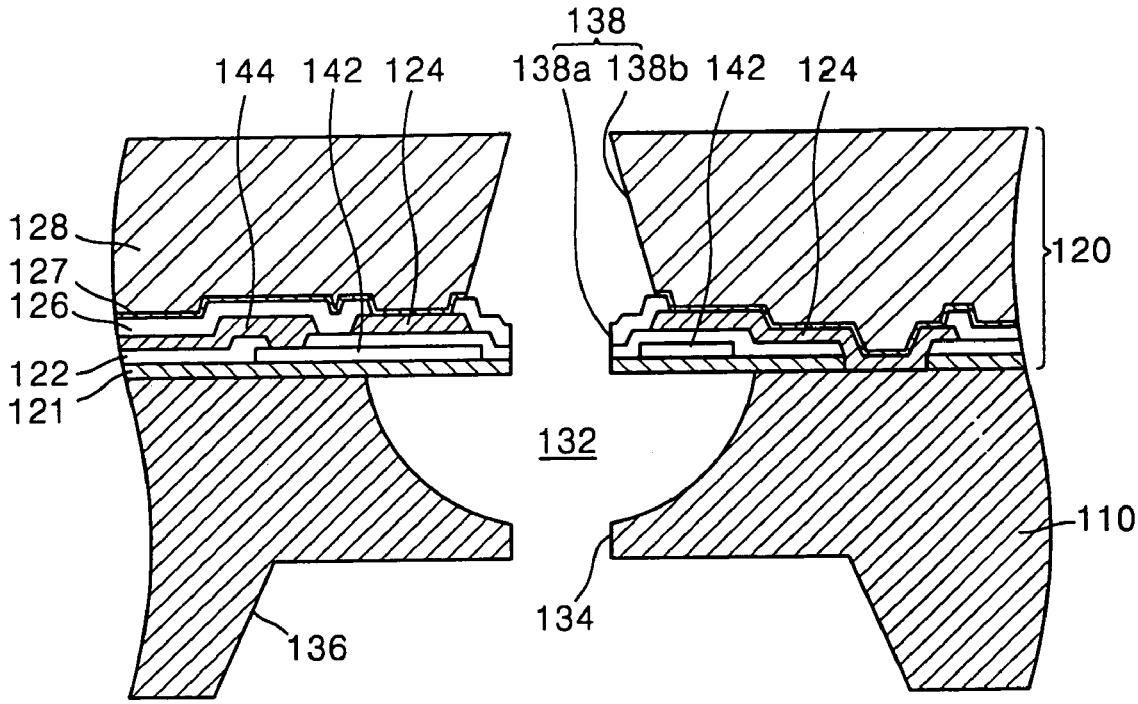

FIG. 17 shows the state in which the manifold 136 and the ink channel 134 have been formed by etching the substrate 110 from the rear surface. Specifically, an etch mask that limits a region to be etched is formed on the rear surface of the substrate 110, and a wet etching on the rear surface of the substrate 110 is performed using tetramethyl ammonium hydroxide (TMAH) as an etchant to form the manifold 136 having an inclined side surface. Alternatively, the manifold 136 may be formed by anisotropically dry-etching the rear surface of the substrate 110. Subsequently, an etch mask that defines the ink channel 134 is formed on the rear surface of the substrate 110 where the manifold 136 has been formed, and the substrate 110 between the manifold 136 and the ink chamber 132 is dry-etched by RIE, thereby forming the ink channel 134. Meanwhile, the ink channel 134 may be formed by etching the substrate 110 at the bottom of the ink chamber 132 through the nozzle 138.

After having undergone the above steps, the upper nozzle 138*b* having the tapered shape as shown in FIG. 17 is formed, and the monolithic ink-jet printhead according to the present invention having the nozzle plate 120 with the heat dissipating layer 128 made of a metal is completed.

Figure 18:
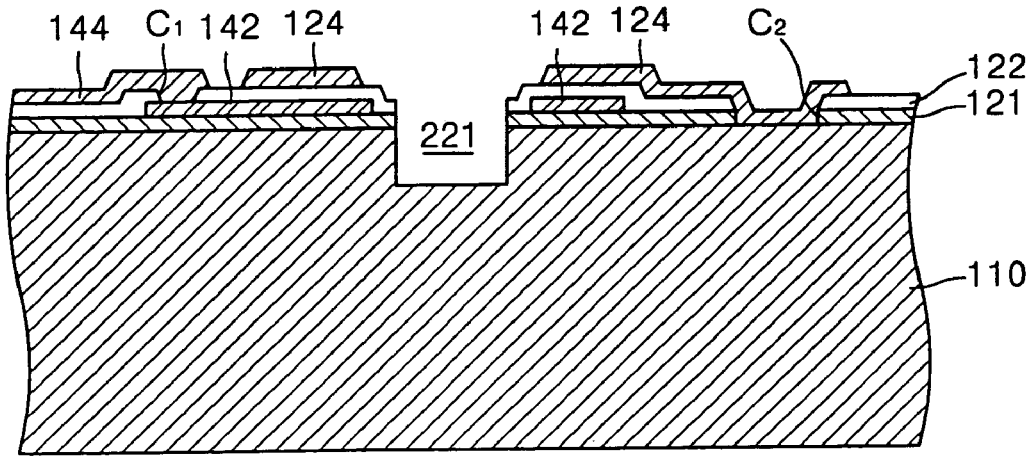
FIGS. 18 through 20 illustrate cross-sectional views for explaining stages in a method for manufacturing the ink-jet printhead having the nozzle plate shown in FIG. 5 according to a preferred embodiment of the present invention.
Figure 19:
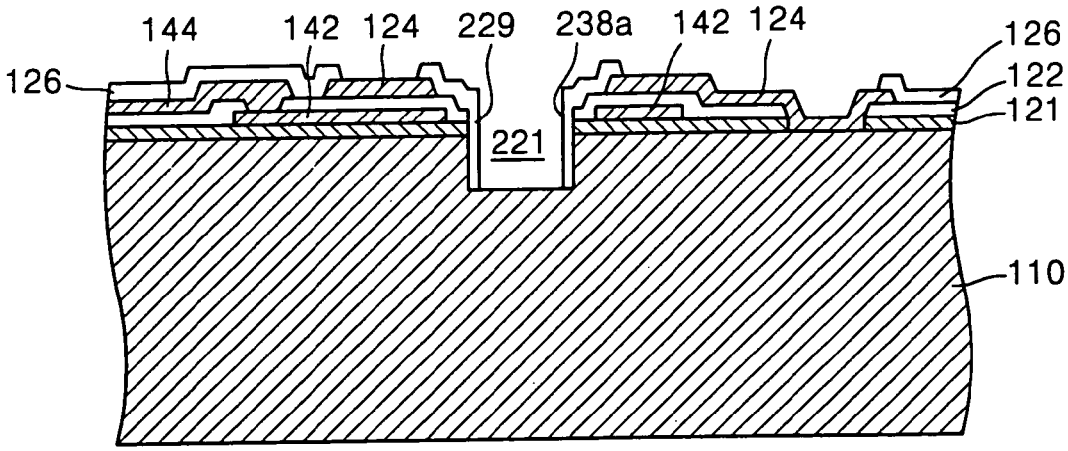
Figure 20:
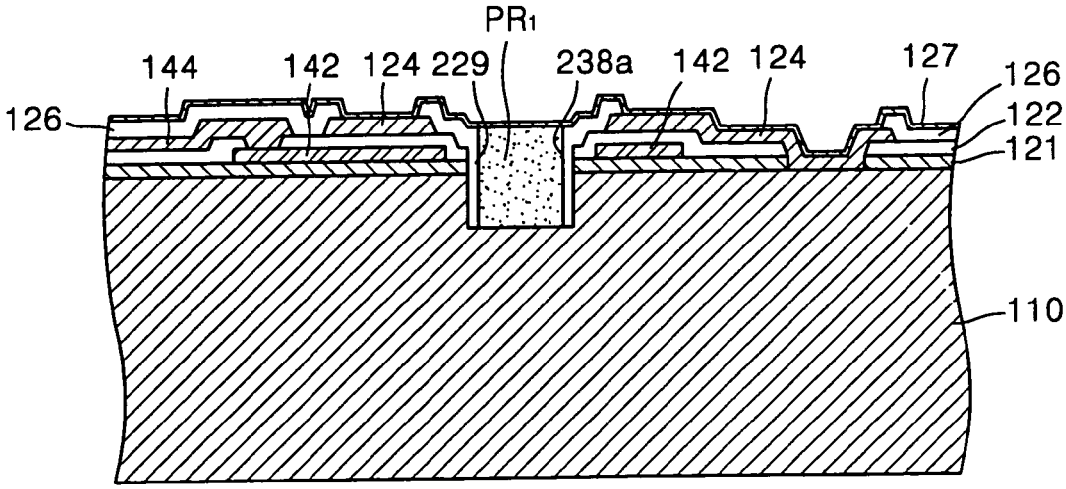

FIGS. 18 through 20 illustrate cross-sectional views for explaining stages in a method for manufacturing the ink-jet printhead having the nozzle plate shown in FIG. 5 according to a preferred embodiment of the present invention.

The method for manufacturing the ink-jet printhead having the nozzle plate shown in FIG. 5 is the same as the method for manufacturing the ink-jet printhead shown in FIG. 4, except that the step of forming the nozzle guide (229 of FIG. 5) is added. That is, the method includes the same steps as shown in FIGS. 7–9, an additional step of forming the nozzle guide 229, and the same steps as shown in FIGS. 13–17. Thus, the manufacturing method will now be described with respect to this difference.

As shown in FIG. 18, after the step shown in FIG. 9, the second and first passivation layers 122 and 121 are anisotropically etched within the inner boundary of the heater 142 to a diameter of about 16–40 μm using RIE. The substrate 110 is then anisotropically etched in the same way to form a hole 221 of a predetermined depth.

Subsequently, as shown in FIG. 19, the third passivation layer 126 is formed over the entire surface of the resulting structure of FIG. 18. As described above, the third passivation layer 126 may be formed by depositing TEOS oxide by PECVD to a thickness of about 0.7–1 μm. The nozzle guide 229 is formed by the TEOS oxide deposited within the hole 221 and defines the lower nozzle 238*a*. The third passivation layer 126 is then partially etched to expose the heat conductive layer 124, and the bottom surface of the hole 221 is etched to expose the substrate 110.

Alternatively, the hole 221 may be formed after formation of the third passivation layer 126. In this case, another material layer is deposited inside the hole 221 or on the third passivation layer 126 to form the nozzle guide 229.

As shown in FIG. 20, the first sacrificial layer $PR_1$ made from a photoresist is then formed within the lower nozzle 238*a* defined by the nozzle guide 229, and the seed layer 127 for electroplating is formed as described above. After having undergone the steps shown in FIGS. 13–17 as subsequent steps, the ink-jet printhead with the nozzle guide 229 formed along the lower nozzle 238*a* as shown in FIG. 5 is completed.

As described above, a monolithic ink-jet printhead and a method for manufacturing the same according to the present invention have the following advantages.

First, the directionality of an ink droplet to be ejected can be improved due to a sufficient length of a nozzle, and a meniscus can be maintained within the nozzle so that a stable ink refill operation is allowed. Further, since an upper nozzle formed in a heat dissipating layer has a tapered shape, a fluid resistance is reduced so that an ejection speed of the ink droplet increases.

Second, a heat sinking capability is increased due to the heat dissipation layer made of a thick metal so that the ink ejection performance and an operating frequency can be increased, and a printing error and heater breakage due to overheat during high-speed printing can be prevented.

Third, since a nozzle plate having a nozzle is formed integrally with a substrate having an ink chamber and an ink channel formed thereon, the ink-jet printhead can be manufactured on a single wafer using a single process. This eliminates the conventional problems of misalignment between the ink chamber and the nozzle, thereby increasing the ink ejection performance and a manufacturing yield.

Preferred embodiments of the present invention have been disclosed herein and, although specific terms are employed, they are used and are to be interpreted in a generic and descriptive sense only and not for purpose of limitation. For example, materials used to form the constitutive elements of a printhead according to the present invention may not be limited to those described herein. That is, the substrate may be formed of a material having good processibility, other than silicon, and the same is true of a heater, a conductor, a passivation layer, a heat conductive layer, or a heat dissipating layer. In addition, the stacking and formation method for each material are only examples, and a variety of deposition and etching techniques may be adopted. Furthermore, specific numeric values illustrated in each step may vary within a range in which the manufactured printhead can operate normally. In addition, sequence of process steps in a method of manufacturing a printhead according to this invention may differ. Accordingly, it will be understood by those of ordinary skill in the art that various changes in form and details may be made without departing from the spirit and scope of the present invention as set forth in the following claims.

What is claimed is:

1. A method for manufacturing a monolithic ink-jet printhead, comprising:

(a) preparing a substrate;

(b) stacking a plurality of passivation layers on the substrate and forming a heater and a conductor connected to the heater between adjacent passivation layers of the plurality of passivation layers;

(c) forming a heat dissipating layer made of a metal on the plurality of passivation layers, forming a lower nozzle on the passivation layers, and forming an upper nozzle on the heat dissipating layer in a tapered shape in which a cross-sectional area thereof decreases gradually toward an exit to construct a nozzle plate including the passivation layers and the heat dissipating layer integrally with the substrate; and (d) etching the substrate to form an ink chamber to be supplied with ink, a manifold for supplying ink to the ink chamber, and an ink channel for connecting the ink chamber with the manifold.

2. The method as claimed in claim 1, wherein in (a), the substrate is made of a silicon wafer.

3. The method as claimed in claim 1, wherein (b) comprises:

forming a first passivation layer on an upper surface of the substrate;

forming the heater on the first passivation layer;

forming a second passivation layer on the first passivation layer and the heater;

forming the conductor on the second passivation layer; and forming a third passivation layer on the second passivation layer and the conductor.

4. The method as claimed in claim 1, wherein in (b), a heater conductive layer located above the ink chamber is formed between the passivation layers, whereby the heat conductive layer is insulated from the heater and conductor and contacts the substrate and heat dissipating layer.

5. The method as claimed in claim 4, wherein the heat conductive layer is formed by depositing a metal to a predetermined thickness using a sputtering method.

6. The method as claimed in claim 4, wherein the heat conductive layer and the conductor are simultaneously formed from the same metal.

7. The method as claimed in claim 4, wherein after forming an insulating layer on the conductor, the heater conductive layer is formed on the insulating layer.

8. The method as claimed in claim 1, wherein (c) comprises:

etching the passivation layers on the inside of the heater to form the lower nozzle;

forming a first sacrificial layer within the lower nozzle;

forming a second sacrificial layer for forming the upper nozzle on the first sacrificial layer in a tapered shape;

forming the heat dissipating layer on the passivation layers by electroplating; and removing the second sacrificial layer and the first sacrificial layer to form a nozzle having the lower nozzle and the upper nozzle.

9. The method as claimed in claim 8, wherein the lower nozzle is formed in a cylindrical shape by dry etching the passivation layers using reactive ion etching (RIE).

10. The method as claimed in claim 8, wherein the first and second sacrificial layers are made from photoresist.

11. The method as claimed in claim 10, wherein forming the second sacrificial layer comprises:

incliningly patterning the photoresist by a proximity exposure for exposing the photoresist using a photomask which is inclined to be separated from a surface of the photoresist by a predetermined distance.

12. The method as claimed in claim 11, wherein an inclination of the second sacrificial layer is adjusted by a space between the photomask and the photoresist and an exposure energy.

13. The method as claimed in claim 8, further comprising:

forming a seed layer for electroplating of the heat dissipating layer on the first sacrificial layer and the passivation layers, prior to formation of the second sacrificial layer.

14. The method as claimed in claim 13, wherein after forming a seed layer for electroplating of the heat dissipating layer on the passivation layers, the first sacrificial layer and the second sacrificial layer are formed integrally with each other.

15. The method as claimed in claim 8, wherein the heat dissipating layer is made of a transition element metal of including nickel and gold.

16. The method as claimed in claim 8, wherein the heat dissipating layer is formed to a thickness of about 10–50 μm.

17. method as claimed in claim 8, further comprising planarizing an upper surface of the heat dissipating layer by chemical mechanical polishing (CMP) after forming the heat dissipating layer.

18. The method as claimed in claim 8, wherein the formation of the lower nozzle comprises:

anisotropically etching the passivation layers and the substrate within an area of the heater to form a hole of a predetermined depth;

depositing a predetermined material layer on an inner surface of the hole; and etching the material layer formed at a bottom of the hole to expose the substrate while at the same time forming a nozzle guide made of the material layer for defining the lower nozzle along a sidewall of the hole.

19. The method as claimed in claim 1, wherein (d) comprises:

etching the substrate exposed through the nozzle to form the ink chamber;

etching a rear surface of the substrate to form the manifold; and forming the ink channel by etching the substrate so that it penetrates the substrate between the manifold and the ink chamber.

* * * * *